United States Patent [19]

Noack

[11] 4,026,664

[45] May 31, 1977

[54] CATALYZED HYDRAZINE COMPOUND CORROSION INHIBITING COMPOSITION CONTAINING A QUINONE COMPOUND AND A COMPLEX OF METAL SALT AND AN ORTHO AROMATIC COMPOUND

[75] Inventor: Manfred G. Noack, Northford, Conn.

[73] Assignee: Olin Corporation, New Haven, Conn.

[22] Filed: May 24, 1976

[21] Appl. No.: 689,229

Related U.S. Application Data

[63] Continuation-in-part of Ser. No. 606,550, Aug. 21, 1975.

[52] U.S. Cl. ..... 21/2.7 R; 21/2.5 R; 106/14; 252/389 R; 252/390; 252/400 R

[51] Int. Cl.[2] ..... C23F 11/18; C23F 11/14

[58] Field of Search ..... 252/389 R, 390, 400 R; 21/2.7 R, 2.5 R; 106/14

[56] References Cited

UNITED STATES PATENTS

| | | | |
|---|---|---|---|
| 2,270,577 | 1/1942 | Bergstrom et al. | 252/401 |
| 3,551,349 | 12/1970 | Kallfass | 252/390 |
| 3,556,748 | 1/1971 | Stedman | 252/401 |
| 3,625,888 | 12/1971 | Redmore | 252/389 R |
| 3,639,263 | 2/1972 | Troscinski et al. | 21/2.7 R |
| 3,645,896 | 2/1972 | Larson | 21/2.7 R |
| 3,686,123 | 8/1972 | Hiroski | 21/2.7 R |
| 3,687,610 | 8/1972 | Gilson et al. | 21/2.7 R |
| 3,785,995 | 1/1974 | Kalil | 252/384 |

*Primary Examiner*—Richard E. Schafer
*Assistant Examiner*—Irwin Gluck
*Attorney, Agent, or Firm*—William A. Simons; F. A. Iskander; Thomas P. O'Day

[57] ABSTRACT

Corrosion inhibiting compositions are described which contain a hydrazine compound, an organometallic complex and a quinone compound. The organometallic complex is the reaction product of a cobaltous, manganous, or cupric inorganic salt and one or more aromatic ligands containing at least two hydroxy or two amino functional groups, or at least one amino and one hydroxy group, in the ortho position with respect to one another. The quinone compound is one which renders the composition compatible with chelating phosphonate scale control agents. The use of these compositions as oxygen scavengers in corrosive environments is also described.

30 Claims, No Drawings

CATALYZED HYDRAZINE COMPOUND CORROSION INHIBITING COMPOSITION CONTAINING A QUINONE COMPOUND AND A COMPLEX OF METAL SALT AND AN ORTHO AROMATIC COMPOUND

This application is a continuation-in-part application of U.S. patent application Ser. No. 606,550, filed on Aug. 21, 1975 by the present inventor, and entitled "Catalyzed Hydrazine Compound Corrosion Inhibiting Composition and Use".

The present invention is directed to catalyzed hydrazine compound corrosion inhibiting compositions and their use in corrosive environments. More particularly, the present invention is directed to compositions comprising a hydrazine compound, a catalytic organometallic complex which enhances oxygen scavenging and a quinone compound which renders the composition compatible with chelating phosphonate scale control agents. The present invention is further directed to the use of these compositions to inhibit or reduce corrosion.

It is well known to use hydrazine compounds for the removal of oxygen from gases and liquids to retard the corrosion of metal surfaces. Among the more important commercial uses of hydrazine compounds for this purpose are in water and steam apparatus such as boilers, hot water heating systems and water cooling systems. These hydrazine compounds are also used in inorganic and organic fluid heat exchange systems, e.g. alkylene glycol coolant systems. It is believed that the hydrazine compound reacts in the systems so that hydrogen from the hydrazine compound combines with the oxygen to form water or other compound so as to bind up the oxygen and thereby inhibit corrosion.

Numerous suggestions have been made in the art to add catalytic or accelerating agents to the hydrazine compound or to otherwise use hydrazine systems to facilitate oxygen removal or scavenging in fluidic corrosive environments or to otherwise treat water systems. Thus, various hydrazine compound systems have been suggested such as described, for example, in U.S. Pat. Nos. 3,551,349 to Kallfass, 3,639,263 to Troscinski et al., 3,645,896 to Larsen, 3,687,610 to Gilson et al., 3,728,281 to Marks et al., 3,808,138 to Yamaguchi et al., and 3,843,547 to Kaufman et al.

It has now been discovered that certain compounds when used in combination with a hydrazine compound in corrosive environments significantly increase the rate of reaction of the hydrazine compound in removing oxygen and this is so to a surprisingly significant degree even at ambient or lower temperatures. The organometallic complexes used in the compositions which comprise the present invention are described in the parent application mentioned above. However, they have not heretofore been taught or suggested in the prior art literature including the above-mentioned patents and yet they are high performers as hydrazine compound oxygen scavenging catalysts. It has further been discovered that the compositions of the present invention are rendered compatible with commercially used chelating phosphonate scale control agents by the inclusion of a quinone compound therein.

The novel compositions of the present invention contain a hydrazine compound, a catalytic organometallic complex and a quinone compound, as mentioned. The hydrazine compound employed in the compositions of the present invention may be hydrazine itself or it may be any of the hydrazine compounds which function as oxygen scavengers in fluidic corrosive environments. Thus, hydrazine compound such as methylhydrazine, ethylhydrazine, propylhydrazine, butylhydrazine, 1,1-dimethylhydrazine, 1,1-dibutylhydrazine, and higher alkylated hydrazine compounds, hydroxy alkyl hydrazines, for example, hydroxyethyl hydrazine, as well as aromatic and aralkyl hydrazine compounds, may be employed. The hydrazine compound may be any of these or a mixture of these and may be used in anhydrous form or in an aqueous solution. The aqueous solution is, of course, the more preferred form when the composition is to be used in water-based corrosive environments. When organic fluid environments are involved, the hydrazine compound may be used in an organic solution, e.g. in a lower alkylene glycol solution. In addition to the hydrazine compound mentioned, the inorganic and/or organic hydrazine compound salts may be employed to replace part or all of the hydrazine compound wherever compatible with the fluidic system. Suitable inorganic hydrazine compounds which may be used include hydrazine phosphate, hydrazine monohydrochloride and dihydrochloride, hydrazine monohydrobromide and dihydrobromide, monohydrosulfate and dihydrosulfate, and the like.

When the hydrazine compound is employed in combination with an inorganic or organic solution, any workable solvent may be used as long as the solvent is compatible with the fluidic corrosive environment which is to be treated. There is no criticality in the amount of solvent employed because the solvent will be compatible with and may become part of the system which is to be treated. However, as a practical matter, regardless of the solvent chosen, generally at least about 1 mole to about 100 moles, and preferably about 1.5 moles to about 10 moles of the solvent is used per mole of hydrazine compound. The exact amount may be somewhat influenced by the particular hydrazine compound chosen or simply may be dictated by the commercial availability of particular solutions. For example, when an aqueous solution is used, the solution may contain about 5 to about 64 percent hydrazine compound by weight, based on the total weight of the water and the hydrazine compound. When an organic solution is used, it may contain about 5 to about 40 percent by weight of hydrazine compound, for example, based on the total weight of the organic solvent and the hydrazine compound.

The organometallic complex used in the compositions of the present invention are reaction products of an inorganic salt and an organic ligand. Specifically, the inorganic salt is one of cobalt, manganese, or copper. The inorganic salt is represented by the formula:

$$MX_{(2/n)} \qquad (I)$$

wherein M is cobaltous, manganous, or cupric metal ion, X is an inorganic anion, and $n$ is the charge of the anion. Thus, the inorganic salt is one of cobalt, manganese, or copper in combination with two uninegative or one dinegative anion such as, for example, $NO_3^-$, $Cl^-$, $Br^-$, $I^-$, or $SO_4^{--}$. The inorganic salt may be used in the form of an aqueous solution or in the anhydrous form as desired.

In order to form the organometallic complex used in the composition of the present invention, the inorganic salt is reacted with one or more organic ligands selected from the group consisting of unsubstituted and substituted ortho-diamino aromatic compounds, unsubstituted and substituted ortho-dihydroxy aromatic compounds, and unsubstituted and substituted ortho-aminohydroxy aromatic compounds. These organic ligands are ortho aromatic compounds which may have only one aromatic ring or may have two or more rings. The substituents which may be part of the organic ligand include any which do not interfere with the formation of the organometallic complexes and with the oxygen scavenger accelerating function of the compositions of the present invention and will include alkyl, aralkyl, and aryl groups, e.g. having about 1 to about 10 and preferably about 1 to about 4 carbon atoms, as well as inorganic substituents such as the sulfonic acid radical. While the two functional groups on the organic ligands are the amino and/or hydroxy radicals in the ortho position relative to one another, the inert substituents may be located in any of the positions not occupied by the aforesaid amino and/or hydroxy groups.

Exemplary of the organic ligands which may be used in forming the organometallic complexes used in the composition of the present invention are:

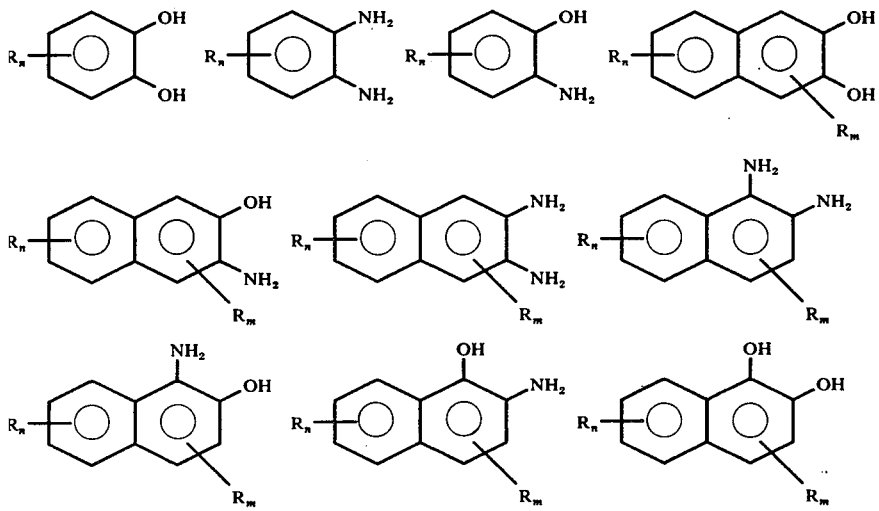

wherein $n$ is an integer from 0 to 4, $m$ is an integer from 0 to 2 and each R is a substituent which does not affect the formation of the organometallic complex and does not detrimentally affect the corrosion inhibiting catalytic functionality of the molecule e.g. lower alkyl, aralkyl, alkaryl, $—SO_3H$, and the like. Also exemplary of the ligands which are useful in the composition and method of the present invention are the anthracene, phenanthrene and phenalene compounds corresponding to those shown above.

The organic ligand may effectively be employed in an organic solvent solution. The amount of water or other solvent used for the inorganic salt and the amount of organic solvent used for the organic ligand will depend upon the compatibility of the particular inorganic salt, organic ligand, and solvents selected. However, in general about 5 to about 50 moles, and preferably about 20 to about 30 moles, of water or other appropriate solvent may be used per mole of inorganic salt. About 5 to about 40 moles and preferably about 20 to about 30 moles of organic solvent may be used in combination with the organic ligand. Among the preferred solvents for the organic ligand are the lower alkylates, such as ethanol and methanol, as well as acetone, MEK and the like.

In forming the organometallic complexes, the inorganic salt is reacted with the organic ligand so that about 0.1 to about 10 or even more moles, and preferably about 1 to about 4 moles of ligand is used per gram atom of metal ion. These two components may advantageously be combined and reacted at room temperature and at atmospheric pressure. However, lower or higher temperatures and negative or positive pressures may be employed, if desired. Thus, temperatures ranging from about 10 to about 100° C and preferably about 20° to about 50° C, and pressures as low as 5 psi up to about 30 psi, and preferably within the range of about 10 to about 15 psi, may be used. At any rate, it can be seen that any combination of temperature and pressure may be used in preparing the organometallic complex provided that there is no significant detrimental effect on the reaction or on the desired products.

The reaction of the inorganic salt and the organic ligand generally occurs in a very short period of time, e.g. instantaneously, and a significant amount of organometallic complex is obtained within a matter of seconds. The organometallic complex may be in liquid form or dissolved in the reaction mixture or it may precipitate out of the reaction mixture. Regardless of the particular form of the organometallic complex, the complex is compatible with the reaction mixture and may be stored therein for an indefinite period of time. Because the reaction occurs in most cases somewhat instantaneously, and because the desired product may be stored in the reaction mixture, there is no criticality to the residence time involved in the reaction between the inorganic salts and the organic ligands used in the present invention. However, if desired, the organometallic compound may be separated from the reaction mixture by any conventional means, e.g. by filtration or by distillation of the solvent. Alternatively, the organometallic compound need not be separated from the reaction mixture and the entire entity may be used as a component for the composition of the present invention.

The quinone compound which is used in the composition of the present invention may be any quinone compound which renders the composition compatible with known chelating phosphonate scale control agents. Among the quinone compounds which may be used are the para-quinones, para-hydroquinones, para-naphthoquinones, para-anthraquinones, and the like, as well as their substituted derivatives. These include alkyl and aryl substituted quinones as well as those having hydrophilic substituents. Among the desired quinone compounds which may be used are the alkylated and arylated para-quinones and para-hydroquinones having about 1 to about 10 carbon atoms in the substituent, and those having substituent derivatives from carboxylic acids, sulfonic acid, carboxylic acid alkali metal salt, sulfonic acid alkali metal salt and nitro. Preferred are the lower alkyl para-quinones and para-hydroquinones having 1 to 5 carbon atoms in the alkyl substituent.

The organometallic complex described above and the quinone compound are combined with the hydrazine compound to form a composition of the present invention. In general, about 0.002 parts to about 0.04 parts by weight of an organometallic complex is combined with one part by weight of the hydrazine compound. Preferably at least about 0.005 parts to about 0.02 parts by weight of the organometallic complex is used per part of hydrazine compound in the composition of the present invention.

In general, about 0.001 parts to about 0.05 parts by weight of a quinone compound is combined with one part by weight of hydrazine compound. Preferably at least about 0.005 to about 0.02 parts by weight of the quinone compound per part by weight of hydrazine compound is used.

The organometallic complex, the quinone compound and the hydrazine compound may be combined prior to use of the resulting composition as a corrosion inhibitor, or the three components may be combined in any combination, e.g. by adding each of them separately to the fluid in the system to be treated. When an aqueous solution of the hydrazine compound is used, and this is particularly preferable for treating water containing systems, about 5 to about 64 percent by weight of the hydrazine compound and preferably about 10 to about 40 percent of the hydrazine compound may be used. This is desirably used in combination with about 0.05 to about 5 percent and preferably about 0.2 to about 2 percent of the organometallic complex, and with about 0.005 to about 3.2 percent and preferably about 0.05 to about 0.40 percent of the quinone compound, by weight, the remainder being water.

As alternatives to combining the organometallic complex and the quinone compound with the hydrazine compound either before or after being added to the fluidic corrosive environment to be treated, other approaches may advantageously be used. In one preferred embodiment, the organic ligand may be dissolved in a hydrazine compound solution and the inorganic salt either in solid or solution form may subsequently be combined with the organic ligand-hydrazine compound solution, either before or after the organic ligand-hydrazine compound solution is added to the fluid system to be treated, and the quinone compound may be added at any step. In another preferred embodiment of the present invention, the inorganic salt may first be dissolved in a hydrazine compound solution and then the organic ligand may be combined therewith either before or after the inorganic salt-hydrazine compound solution is added to the fluidic system to be treated and the quinone compound may be added to any component at any step. In yet another preferred embodiment, the hydrazine compound, the organic ligand and the inorganic salt, and the quinone compound may each independently be added to the fluidic corrosive environment to be treated. It should be noted that in those embodiments wherein the inorganic salt and the organic ligand are not combined until added to the fluidic system to be treated, the organometallic complex is formed in situ. It should also be noted that regardless of the particular combining approach taken the relative amount of hydrazine compound, of organic ligand and inorganic salt, and of quinone compound used are those set forth above.

In the method of the present invention, the compositions are used to inhibit oxygen corrosion in fluidic corrosive environments, as mentioned. The compositions are generally combined with the system to be treated so that at least about a stoichiometric amount of hydrazine compound is present based on the amount of dissolved oxygen in the system. Typically, this may mean that the composition is used so that the hydrazine compound concentration in the fluidic system, after admixing, but before reaction with the dissolved oxygen takes place, is in the range of about 0.001 to about 1,000 ppm, e.g. about 0.01 to about 400 ppm. The particular method used in combining the corrosion inhibiting compositions of the present invention may be any of those which have been previously described and the physical techniques of addition may be any of those which are well known in the art with respect to the use of hydrazine as an oxygen scavenger. Likewise, the methods of determining the amount of oxygen present in a fluidic system are well known in the art and need not be described herein.

The following examples of the present invention are presented for illustrative purposes only, and the present invention should not be construed to be limited thereto:

EXAMPLE 1

Preparation of Composition With Cobalt (II)/Pyrocatechol/Methylhydroquinone Catalyst About 0.237 grams (2.15 millimoles) pyrocatechol and 0.288 grams (2.35 millimoles) methylhydroquinone are dissolved in 56 milliliters of distilled water in a 500 ml Erlenmeyer flask. Subsequent additions of 66 ml hydrazine hydrate (64% $N_2H_4$ by weight) and of 2.62 ml of an aqueous solution containing 20% $CoCl_2 \cdot 6H_2O$ (corresponding to $2.2 \times 10^{-3}$ g atom of $Co^{++}$ion) give a clear, orange-red solution containing approximately 35% hydrazine and 0.6% of catalyst by weight (molar ratio pyrocatechol/cobalt of approximately 1.0).

EXAMPLE 2

Composition With Cobalt (II)/Pyrocatechol/Methylhydroquinone Catalyst

The procedure of Example 1 is repeated except that 1.31 ml of 20% solution of $CoCl_2 \cdot 6H_2O$ are added instead of 2.62 ml, such as to adjust the molar ratio pyrocatechol/cobalt approximately 2.0.

EXAMPLE 3

Composition Containing Manganese/Pyrocatechol/Methylhydroquinone Catalyst

The procedure of Example 1 is repeated except that an aqueous solution containing approximately 2.2 millimoles of $MnSO_4$ in 2.62 ml are added instead of the 2.62 milliliter containing the equivalent amount of cobaltous chloride. An oxygen-scavenging and corrosion inhibiting composition containing approximately 35% hydrazine, 0.6% of manganese/pyrocatechol/-methlyhydroquinone catalyst is thus obtained.

EXAMPLE 4

Composition Containing 3,4-Toluene Diamine/Cobalt Ion/Methylhydroquinone Catalyst In an Erlenmeyer flask of approximately 500 ml capacity 0.263 g 3,4-toluene diamine (2.15 millimoles) is combined with 56 milliliters of distilled water and 66 milliliters of hydrazine hydrate. Subsequent additions of 2.2 millimoles $CoCl_2 \cdot 6H_2O$ in 2.62 milliliters of aqueous solution and 0.288 g of methylhydroquinone give, after shaking, a yellow-orange composition containing approximately 35% hydrazine and 0.6% of 3,4-toluene diamine/cobalt/methylhydroquinone catalyst. The molar ratio 3,4-toluene diamine/cobalt (II) is approximately 1.0 in this composition.

EXAMPLE 5

Alternative Composition Containing 3,4-Toluene Diamine/Cobalt Ion/Methylhydroquinone Catalyst The procedure of Example 4 is repeated except that 0.87 ml of 20% aqueous solution of $CoCl_2 \cdot 6H_20$ are added to the hydrazine solution containing 0.263 g of 3,4-toluene diamine such as to obtain a composition wherein the ratio 3,4-toluene diamine/cobalt (II) equals approximately 3.0.

EXAMPLE 6

Composition Containing Aminonaphthol Derivative, Cobaltous Salt and Methylhydroquinone Following the procedure of Example 1, about 0.515 g of 1-amino-2-naphthol-4-sulfonic acid is combined with 0.288 g of methylhydroquinone, 56 ml distilled water, 66 milliliters of hydrazine hydrate, and approximately 2.2 millimoles of $CoCl_2 \cdot 6H_2O$ in 2.62 ml of aqueous solution to obtain a catalyzed hydrazine solution.

EXAMPLE 7

Determination of Catalytic Activity in Absence and Presence of Chelating Scale Control Chemicals The rates of chemical oxygen removal with the activated hydrazine solutions and hydrazine without added catalyst are subsequently determined by the following procedure:

Air-saturated test solutions of pH 10.0 and dissolved oxygen concentration of approximately 8 ppm are prepared in Erlenmeyer flasks of approximately 1,055 ml capacity by dissolving sodium carbonate and bicarbonate until pH 10.0 is obtained. Before measurements are carried out, each flask is heated or cooled as required to bring the solution contained therein to 25.0° C. After fitting a flask readied for measurements as described with a selective membrane electrode for purposes of measuring dissolved oxygen concentration by means of commercial oxygen meter, hydrazine without catalyst and the hydrazine compositions prepared in accordance with Examples 1 through 6 are injected in quantities sufficient to bring $N_2H_4$concentrations before reaction with dissolved oxygen occurs to 150 ppm. The stirred flask is then immediately sealed and oxygen concentrations are recorded as function of time. Each test is then repeated with solutions of pH 10.0 containing, in addition to dissolved oxygen and sodium carbonate and bicarbonate, 2 ppm of the chelating scale control agent of Formula (A), and subsequently, with corresponding solutions containing 2 ppm of the chelating scale control agent of Formula (B), as follows:

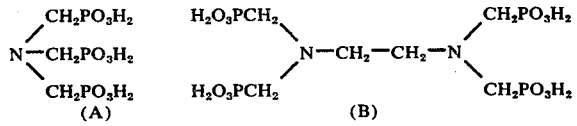

The results shown in Table I demonstrate the catalytic activity of the catalyzed hydrazine solutions in absence and presence of chelating scale control agents, as follows:

TABLE I

CHEMICAL OXYGEN REMOVAL IN ABSENCE AND PRESENCE OF CHELATING SCALE CONTROL AGENTS

| Hydrazine Solution | Percent of Initial Dissolved Oxygen (8 ppm) Removed Within 1 Minute | | |
|---|---|---|---|
| | (a) No Scale Control Agent | (b) Scale Control Agent Formula (A) | (c) Scale Control Agent Formula (B) |
| No Catalyst | 5 | <1 | 0 |
| Solution of Ex. 1 | 95 | 94 | 96 |
| Solution of Ex. 2 | 95 | 96 | 96 |
| Solution of Ex. 3 | 95 | 97 | 97 |
| Solution of Ex. 4 | 91 | 93 | 92 |
| Solution of Ex. 5 | 97 | 95 | 97 |
| Solution of Ex. 6 | 97 | 97 | 97 |

What is claimed is:

1. A composition, comprising:

a. a hydrazine compound;

b. about 0.002 parts to about 0.04 parts by weight of an organometallic complex per part of hydrazine compound, said organometallic complex being the reaction product of:

i. an inorganic salt selected from the group consisting of cobaltous, manganous, and cupric salts; and ii. one or more organic ligands selected from the group consisting of unsubstituted and substituted ortho-diamino aromatic compounds, unsubstituted and substituted ortho-dihydroxy aromatic compounds and unsubstituted and substituted ortho-aminohydroxy aromatic compounds; and c. about 0.001 parts to about 0.05 parts by weight of a quinone compound per part of hydrazine compound.

2. The composition of claim 1 wherein said inorganic salt has the formula:

$$MX_{(2/n)} \quad (I)$$

wherein M is a cobaltous, manganous, or cupric metal ion, X is an inorganic anion, and *n* is the charge of the anion.

3. The composition of claim 2 wherein about 0.005 parts to about 0.02 parts by weight of the organometallic complex is used per part of hydrazine compound.

4. The composition of claim 3 wherein said organometallic complex is the reaction product of an inorganic salt as recited, and a mixture of unsubstituted ortho-diamino aromatic compounds and unsubstituted ortho-dihydroxy aromatic compounds.

5. The composition of claim 1 wherein said hydrazine compound is in anhydrous form.

6. The composition of claim 1 wherein said hydrazine compound is in an aqueous solution containing about 5 to about 64 percent hydrazine compound by weight, based on the total weight of the water and the hydrazine compound.

7. The composition of claim 1 wherein about 0.005 parts to about 0.02 parts by weight of the quinone compound is used per part of hydrazine compound.

8. The composition of claim 7 wherein the quinone compound is a para-quinone, a para-hydroquinone, a para-naphthoquinone, a para-anthraquinone, or a substituted derivative thereof.

9. The composition of claim 8 wherein said hydrazine compound is in an organic solvent solution containing about 5 to about 40 percent hydrazine compound by weight, based on the total weight of the organic solvent and the hydrazine compound.

10. The composition of claim 9 wherein said hydrazine compound is in anhydrous form and wherein the quinone compound is methylhydroquinone.

11. A method of treating a fluidic corrosive environment to remove oxygen therefrom and inhibit corrosion therein, which comprises: treating said environment with a composition comprising:

a. a hydrazine compound;

b. about 0.002 parts to about 0.04 parts by weight of an organometallic complex per part of hydrazine compound, said organometallic complex being the reaction product of:

i. an inorganic salt selected from the group consisting of cobaltous, manganous, and cupric salts; and ii. one or more organic ligands selected from the group consisting of unsubstituted and substituted ortho-diamino aromatic compounds, unsubstituted and substituted ortho-dihydroxy aromatic compounds and unsubstituted and substituted ortho-aminohydroxy aromatic compounds.

c. about 0.001 parts to about 0.05 parts by weight of a quinone compound per part of hydrazine compound.

12. The method of claim 11 wherein said inorganic salt has the formula:

$$MX_{(2/n)} \quad (I)$$

wherein M is a cobaltous, manganous, or cupric metal ion, X is an inorganic anion, and *n* is the charge of the anion.

13. The method of claim 12 wherein about 0.005 parts to about 0.02 parts by weight of the organometallic complex is used per part of hydrazine compound.

14. The method of claim 13 wherein said organometallic complex is the reaction product of an inorganic salt as recited, and a mixture of unsubstituted ortho-diamino aromatic compounds and unsubstituted ortho-dihydroxy aromatic compounds.

15. The method of claim 11 wherein said hydrazine compound is in anhydrous form.

16. The method of claim 11 wherein said hydrazine compound is in an aqueous solution containing about 5 to about 64 percent hydrazine compound by weight, based on the total weight of the water and the hydrazine compound.

17. The method of claim 11 wherein said hydrazine compound is in an organic solvent solution containing about 5 to about 40 percent hydrazine compound by weight, based on the total weight of the organic solvent and the hydrazine compound.

18. The composition of claim 11 wherein about 0.005 parts to about 0.02 parts by weight of the quinone compound is used per part of hydrazine compound.

19. The composition of claim 18 wherein the quinone compound is a para-quinone, a para-hydroquinone, a para-naphthoquinone, a para-anthraquinone or a substituted derivative thereof.

20. The composition of claim 19 wherein said hydrazine compound is in an organic solvent solution containing about 5 to about 40 percent hydrazine compound by weight, based on the total weight of the organic solvent and the hydrazine compound.

21. A method of treating a fluidic corrosive environment to remove oxygen therefrom and inhibit corrosion therein, which comprises:

adding the following components to said environment:

a. a hydrazine compound in at least about a stoichiometric amount, based on the amount of oxygen to be removed;

b. an inorganic salt having the formula:

$$MX_{(2/n)} \quad (I)$$

wherein M is a cobaltous, manganous, or cupric metal ion, X is an inorganic ion, and *n* is the charge of the ion;

c. one or more organic ligands selected from the group consisting of unsubstituted and substituted ortho-diamino aromatic compounds, unsubstituted and substituted ortho-dihydroxy aromatic compounds and substituted and unsubstituted ortho-aminohydroxy aromatic compounds, and wherein about 0.1 to about 10 moles of ligand are used per gram-atom of metal ion and wherein from about 0.002 parts to about 0.04 parts by weight of total organic ligand and inorganic salt are used per part of said hydrazine compound; and d. about 0.001 parts to about 0.05 parts by weight of a quinone compound per part of hydrazine compound.

22. The method of claim 21 wherein each of said components are added separately to said environment.

23. The method of claim 21 wherein said organic ligand and said hydrazine compound are combined prior to being added to said environment.

24. The method of claim 21 wherein said inorganic salt and said hydrazine compound are combined prior to being added to said environment.

25. The method of claim 21 wherein said inorganic salt and said organic ligand are combined prior to being added to said environment.

26. The method of claim 21 wherein about 0.005 parts to about 0.02 parts by weight of total organic ligand and inorganic salt, and about 0.005 parts to about 0.02 parts by weight of quinone compound are used per part of said hydrazine compound.

27. The method of claim 26 wherein each of said components are added separately to said environment.

28. The method of claim 26 wherein said organic ligand and said hydrazine compound are combined prior to being added to said environment.

29. The method of claim 26 wherein said inorganic salt and said hydrazine compound are combined prior to being added to said environment.

30. The method of claim 26 wherein said inorganic salt and said organic ligand are combined prior to being added to said environment.

* * * * *